US005314245A

United States Patent [19]

Blach

[11] Patent Number: 5,314,245

[45] Date of Patent: May 24, 1994

[54] ARRANGEMENT FOR MIXING AND KNEADING OF MATERIALS WITH A SCREW SHAFT AND AT LEAST ONE SCREW ELEMENT CONNECTED WITH ONE ANOTHER BY WEDGES

[76] Inventor: Josef A. Blach, Hof 120, 5310 Mondsee, Austria

[21] Appl. No.: 14,372

[22] Filed: Feb. 5, 1993

[51] Int. Cl.[5] ..... B01F 7/08

[52] U.S. Cl. ..... 366/79; 366/331; 403/355; 403/367; 425/192 R

[58] Field of Search ..... 366/69, 76, 79, 83–85, 366/100, 318, 331; 403/355–358, 367; 425/183, 192 R, 204, 208, 209

[56] References Cited

U.S. PATENT DOCUMENTS

| | | | |
|---|---|---|---|
| 118,474 | 8/1871 | Ochsner | 403/356 |
| 248,400 | 10/1881 | Burt | 403/356 |
| 732,738 | 7/1903 | Hammen | 403/358 |
| 1,460,222 | 6/1923 | Benjamin | 403/356 |
| 1,825,239 | 9/1931 | Meyer | 403/356 |
| 2,681,239 | 6/1954 | Gillen | 403/356 |
| 2,994,548 | 8/1961 | McGogy | 403/356 |
| 3,175,852 | 3/1965 | Durand | 403/356 |
| 3,254,367 | 6/1966 | Erdmenger | 366/85 |
| 3,305,894 | 2/1967 | Boden et al. | 366/85 |
| 3,421,783 | 1/1969 | Sakai | 403/357 |
| 4,358,215 | 11/1982 | Rivin | 403/357 |
| 4,875,847 | 10/1989 | Wenger et al. | 366/85 X |
| 5,048,971 | 9/1991 | Wall et al. | 366/85 |

FOREIGN PATENT DOCUMENTS

| | | | |
|---|---|---|---|
| 813154 | 6/1951 | Fed. Rep. of Germany . | |
| 609576 | 7/1956 | Fed. Rep. of Germany | 403/356 |
| 2329514 | 1/1975 | Fed. Rep. of Germany | 403/358 |
| 2617864 | 11/1977 | Fed. Rep. of Germany | 403/355 |
| 3406665 | 9/1985 | Fed. Rep. of Germany | 366/79 |
| 567959 | 12/1923 | France | 403/356 |
| 1206810 | 4/1959 | France | 425/208 |
| 1416667 | 9/1965 | France | 425/204 |
| 312974 | 10/1971 | U.S.S.R. | 403/358 |
| 724820 | 3/1980 | U.S.S.R. | 403/355 |

*Primary Examiner*—Harvey C. Hornsby
*Assistant Examiner*—Charles Cooley
*Attorney, Agent, or Firm*—Michael J. Striker

[57] ABSTRACT

An arrangement for mixing and/or kneading of viscous, plastic, powder or grain materials, comprises a housing provided with a housing opening, a screw shaft driveably arranged in the housing opening and having a torque transmitting shaft and a plurality of screw elements arranged one behind the other on the shaft, a wedge connecting the screw elements with the shaft and having a substantially rectangular cross-section with two long sides and two short sides. The wedge is arranged so that one long side of the cross-section which faces toward the screw element substantially coincides with a tangent to a shaft circumference and is arranged substantially in the screw element, another long side of the cross-section which faces toward the shaft is arranged substantially in the shaft, one short side of the cross-section which extends in a direction opposite to the rotary direction of the shaft is located substantially in the shaft, another short side of the cross-section which extends in the rotary direction of the shaft is arranged substantially in the screw element. The long and short sides abut against one another in the shaft and in the screw element and are arranged substantially at a right angle relative to one another and form an open groove with round corners.

12 Claims, 3 Drawing Sheets

ARRANGEMENT FOR MIXING AND KNEADING OF MATERIALS WITH A SCREW SHAFT AND AT LEAST ONE SCREW ELEMENT CONNECTED WITH ONE ANOTHER BY WEDGES

BACKGROUND OF THE INVENTION

The present invention relates to an arrangement for mixing and/or kneading of viscous, plastic, powder or grain materials.

More particularly, it relates to an arrangement which has a driveable screw shaft arranged in a tubular housing opening and composed of a shaft which transmits a torque and a plurality of screw elements arranged on the shaft one behind the other and fixedly connecting the shaft by at least one edge with a substantially rectangular cross-section. The screw shaft operates for partial load distribution, while the wedge is partially arranged on the shaft and partially in the screw element so that the longer sides of the wedge cross-section extend parallel to a tangent to the shaft periphery and its shorter sides are arranged at a right angle to the longer sides.

An arrangement of the above-mentioned type is disclosed for example in the German document DE-C-813,154. During kneading with this arrangement a maximum quantity of energy of the driven shaft is transmitted to the material to be treated in the arrangement and converted in the material into work. The wedge or the wedges between the shaft and the screw elements position the screw elements in the proper turning position on the shaft and the torque during the operation is transmitted from the shaft through the screw elements to the material to be worked.

In the known arrangement swelling torsion loading of the shaft acts only in one direction, which influences its fatigue line. For the loading capacity of the shaft, it is necessary to determine the maximum stress concentration which occurs in the wedge groove and whose maximum permissible value must not be exceeded. The wedge or the wedges are arranged so that their cross-section is radial and symmetrical substantially for each half in the shaft and in the screw elements. This however produces a groove bottom which is not optimal with respect to a notch effect and also results in a poor accessibility of the groove for testing and cleaning.

SUMMARY OF THE INVENTION

Accordingly, it is an object of the present invention to provide an arrangement of the above mentioned type, in which the coupling between the shaft and the screw elements and the efficiency of the shaft is improved so that the transmittable torque can be increased without increasing of the arrangement sizes.

In keeping with these objects and with others which will become apparent hereinafter, one feature of the present invention resides, briefly stated, in an arrangement for mixing or kneading of materials, in which the long side of the wedge cross-section facing the screw element substantially coincides with the tangent and is located substantially in the screw element, the long side of the wedge cross-section is located substantially in the shaft, the short side of the wedge cross-section extending in the direction which is opposite to the rotary direction of the shaft is located substantially in the shaft, the short side of the wedge cross-section extending in the rotary direction of the shaft is located substantially in the screw element, and the longer and shorter sides in the shaft and in the screw element abut against one another and arranged substantially at a right angle relative to one another, and also form a groove which is open and has rounded corners.

When the wedge or the wedges are arranged in accordance with the present invention in the shaft and the screw elements, in other word tangentially and asymmetrically, then with the same dimensions the shaft can transfer a substantially high torque since the calculated safety against the fatigue break is substantially increased.

The wedges which are spring biased with the pressure load provide for an improved radial and axial load distribution with at least two wedges acting in the same rotary direction. The thusly improved three-dimensional action reduces substantially the surface pressure and provides for a reduction of the surface wear for the wedges.

It is no longer required to mount the wedge in the shaft with a press fit. Instead, they can be arranged with a small play in a springy manner between the shaft and the screw element. This simplifies also the latter dismounting of the screw shaft. A further advantage is that the screw elements due to the asymmetrical position of the wedge can be fitted on the shaft non-exchangeably only in a predetermined position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. *3a–3d* are views showing several embodiments of the wedge in a cross-section and on a plan view wherein FIG. *3a* shows a wedge with a plurality of longitudinal grooves arranged parallel to its longitudinal axis, FIG. *3b* shows a wedge with cutouts extending inclinedly to the longitudinal sides of the wedge, FIG. *3c* shows a wedge with cutouts extending parallel to the longitudinal edges of the wedge and also at a right angle to the longitudinal edges, and FIG. *3d* is a view showing a wedge with cutouts extending only parallel to the longitudinal axis of the wedge but differently from the wedge of FIG. *3c.

DESCRIPTION OF THE PREFERRED EMBODIMENTS

Figure 1:
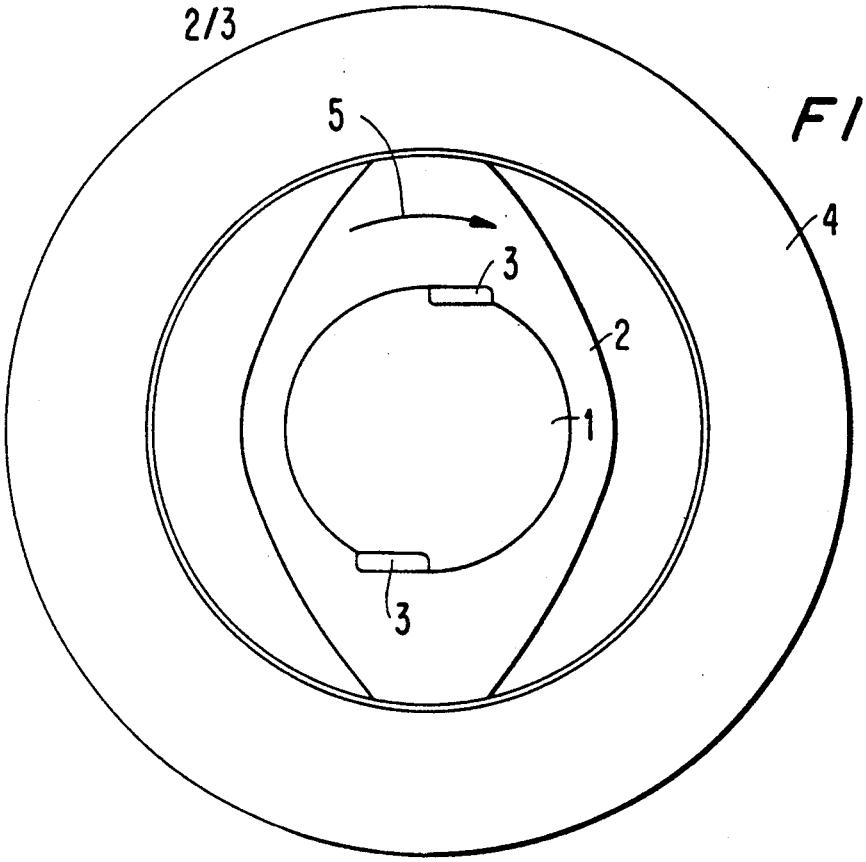
FIG. 1 is a view schematically showing a cross-section of an inventive arrangement of a screw shaft and screw element.

As can be seen from FIG. 1, a screw shaft machine shown in the drawings has a shaft 1 and a plurality of screw elements 2 which are arranged on the shaft 1 one behind the other and offset relative to one another in a peripheral direction. Only one screw element is shown in the drawing. The screw element 2 is coupled in the shaft in form-locking (interengaging) manner by a wedge 3. The wedge can have a side ratio of the shorter sides to the longer sides between 1:3 and 1:6. A screw shaft which is formed in this manner is arranged rotatably in a circular inner opening of the housing 4. The screw shaft machine is formed so that it has several screw shafts and a housing corresponding to the number of the shafts. When the screw shaft machine has only two screw shafts, the inner opening of the housing has a form of a lying number 8. The screw shafts can be driven in opposite directions or in the same direction. The rotary direction of the screw shaft in FIG. 1 is identified with reference numeral 5. In operation an opposite rotary direction is not possible.

Figure 2:
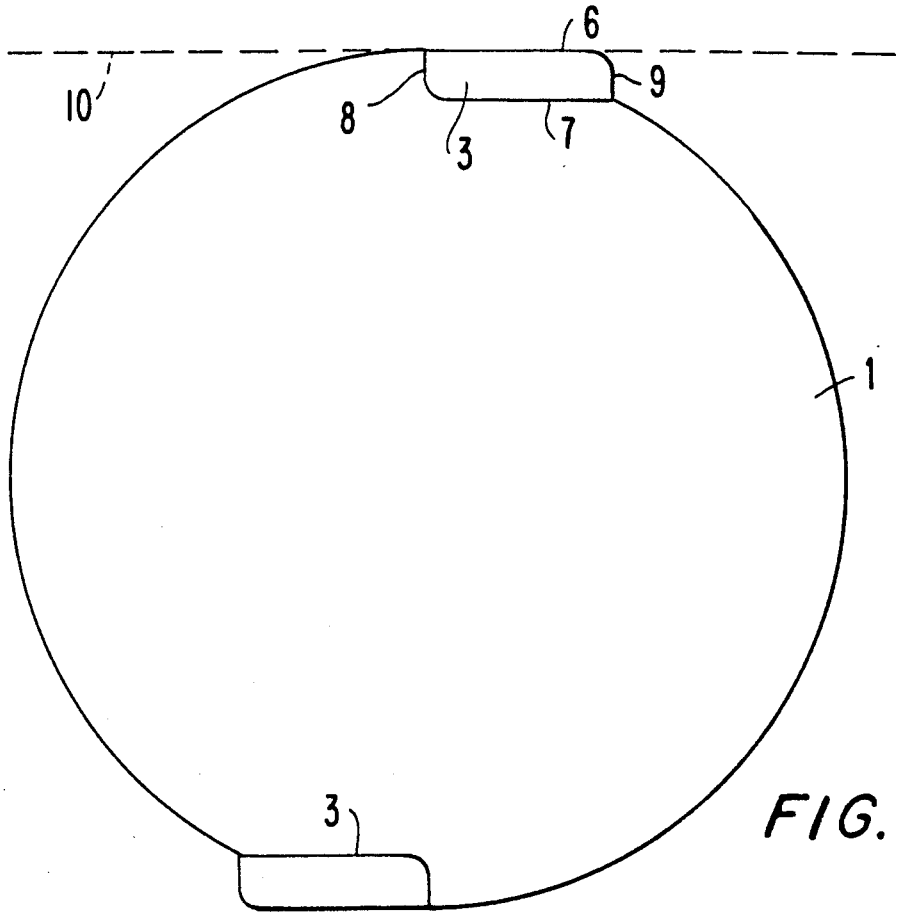
FIG. 2 is a view showing an enlarged cross-section of a shaft with wedges of the arrangement in accordance with the present invention.

FIG. 2 illustrates the position of the wedges 3 which are located diametrically opposite to one another. They are arranged asymmetrically relative to an imaginary thread circle on the periphery of the shaft. Each wedge has a substantially rectangular cross-section, with the exception of the rounded corners. The cross-section has an outer longer side 6, an inner longer side 7 and two short sides 8 and 9. As can be seen from FIG. 2, the wedge 3 is arranged in the shaft 1 and the screw element 2 so that its long side 6 coincides with the tangent 10 to the shaft circumference. The long side 7 of the wedge cross-section is parallel to the long side 6, and the shorter sides are perpendicular to the longer side.

In the position of the wedge in the shaft and in screw element shown in FIG. 2, an optimal embodiment is obtained. The short side 8 is completely inserted in the shaft 1, the short side 9 is completely inserted in the not shown screw element. Therefore the short sides 8 and 9 of the wedge are subjected during the operation only to a corresponding pressure.

While FIG. 2 shows the optimal position of the wedges 3, some deviations of the position are possible within certain limits without worsening of the wedge loading. For example, an insignificant parallel displacement of the wedge 3 outwardly and to the side is possible as well.

Figure 3A:
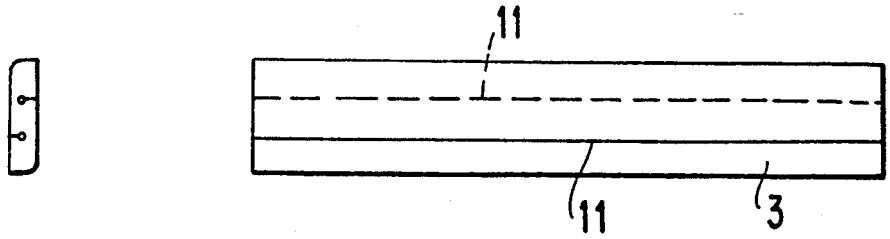

FIGS. 3*a*–3*d* show different embodiments of an elastic wedge 3 which is formed as a spring member. In the embodiment of FIG. 3*a* the wedge has a plurality of longitudinal grooves 11 which are arranged parallel to the longitudinal edges. One longitudinal groove opens at the lower side and another longitudinal groove opens at the upper side of the wedge.

Figure 3B:
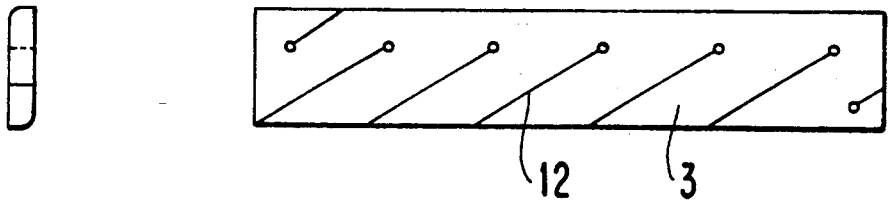

In the embodiment of FIG. 3*b* the wedge has cutouts 12 which extend inclinedly to the longitudinal sides of the wedge.

Figure 3C:
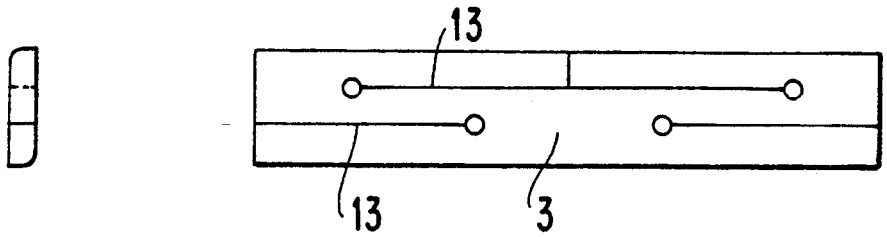

In the embodiment of FIG. 3*c* the wedge has cutouts 3 which extend parallel to the longitudinal edges of the wedge also at a right angle to the longitudinal edges.

Figure 3D:
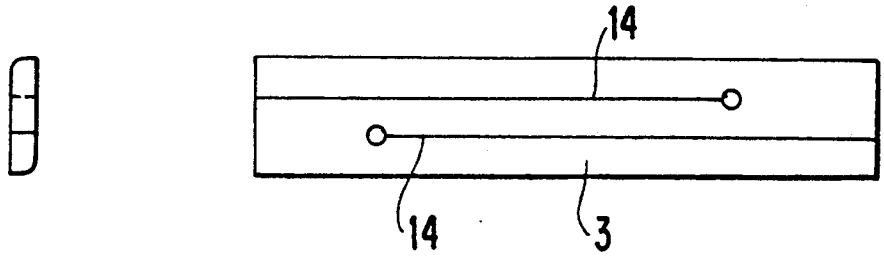

In the embodiment of FIG. 3*d* the wedge has cutouts 14 which extend only parallel to the longitudinal axis of the wedge. However, they have different arrangement than the cutouts in FIG. 3*c*.

Figure 4:
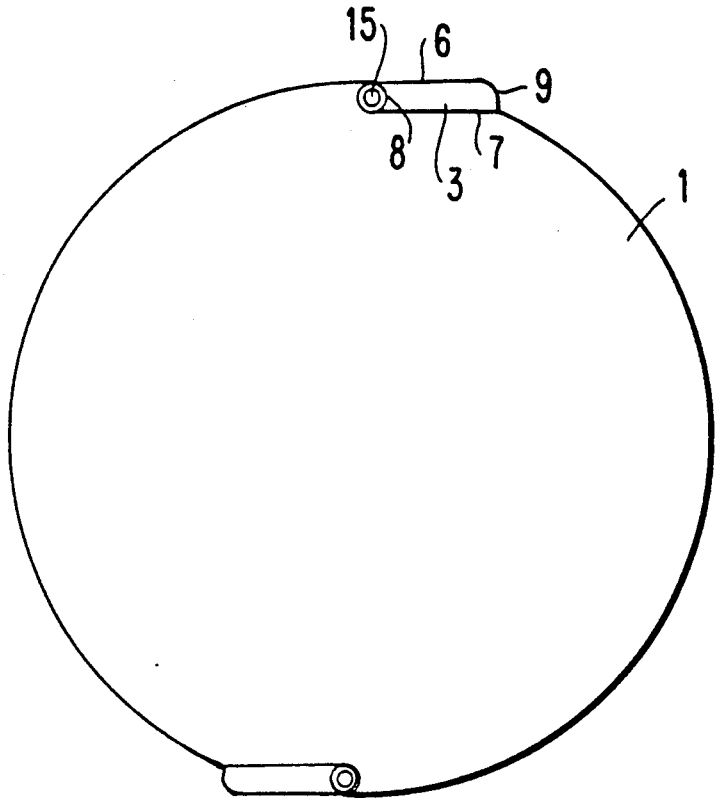
* and FIG. 4 is a view showing a cross-section of a shaft with a wedge provided with an elastic pipe.

FIG. 4 shows a further embodiment of the wedge 3. The wedge shown here is not grooved and springy, but instead it is solid. The short side 8 is formed similarly to a hollow channel flute, and an arrested elastic pipe 15 is located between the short side 8 and the opposite groove wall in the shaft.

It will be understood that each of the elements described above, or two or more together, may also find a useful application in other types of constructions differing from the types described above.

While the invention has been illustrated and described as embodied in an arrangement for mixing and/or kneading of viscous, plastic, powder or grain materials, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for mixing and/or kneading a viscous, plastic, powder or grain materials, comprising a housing provided with a housing opening; a screw shaft driveably arranged in said housing opening and having a torque transmitting shaft and at least one screw element arranged on said shaft, said shaft and said screw element in assembled condition forming two diametrically opposite open grooves, each defined by two long walls and two short walls arranged so that said long walls intersect said short walls at a right angle to form corners which are rounded; two wedges connecting said at least one screw element with said shaft and each wedge having a substantially rectangular cross-section with two long sides and two short sides, each of said wedges being arranged so that one long side of said cross-section which faces toward said screw element substantially coincides with a tangent to a circumference of said shaft and is arranged substantially in said screw element, another long side of said cross-section which faces toward said shaft is arranged substantially in said shaft, one short side of said cross-section which extends in a direction opposite to the rotary direction of said shaft is located substantially in said shaft, another short side of said cross-section which extends in the rotary direction of said shaft is arranged substantially in said screw element, said long and short sides of said cross-section abutting said shaft and said screw element, said wedges having rounded corners said long sides of said cross-section intersecting said short sides of said cross-section at a right angle to form said rounded corners of said wedges, said wedges being located diametrically opposite to one another and received in said diametrically opposite open grooves.

2. An arrangement as defined in claim 1, wherein said cross-section of each of said wedges has a side ratio of said short sides to said long sides between 1:3 and 1:6.

3. An arrangement as defined in claim 1, wherein each of said wedges is formed as a spring member.

4. An arrangement as defined in claim 3, wherein each of said wedges has a plurality of recesses.

5. An arrangement as defined in claim 4, wherein said recesses are formed as cutouts.

6. An arrangement as defined in claim 4, wherein said recesses are formed as grooves.

7. An arrangement as defined in claim 4, wherein said recesses extend in a direction of said long sides of each of said wedges.

8. An arrangement as defined in claim 4, wherein said recesses extend inclinedly relative to said long sides of each of said wedges.

9. An arrangement as defined in claim 4, wherein said recesses extend over a partial length of each of said wedges.

10. An arrangement as defined in claim 4, wherein said recesses extend perpendicular to said long sides of each of said wedges.

11. An arrangement as defined in claim 4, wherein said recesses extend parallel and perpendicular to said long sides of each of said wedges.

12. An arrangement as defined in claim 1, wherein said shaft has one of said short walls facing each of said wedges further comprising an elastic tubular element located between said one of said short walls of said short sides of each of said wedges.

* * * * *